US010471488B2

(12) United States Patent
Moretti et al.

(10) Patent No.: US 10,471,488 B2
(45) Date of Patent: Nov. 12, 2019

(54) MACHINE FOR BENDING SHEET METAL

(71) Applicant: COSMA S.R.L., Milan (IT)

(72) Inventors: Bruno Moretti, Milan (IT); Fabrizio Beretta, Milan (IT)

(73) Assignee: COSMA S.R.L., Milan (IT)

( * ) Notice: Subject to any disclaimer, the term of this patent is extended or adjusted under 35 U.S.C. 154(b) by 703 days.

(21) Appl. No.: 15/109,006

(22) PCT Filed: Dec. 29, 2014

(86) PCT No.: PCT/EP2014/079385
§ 371 (c)(1),
(2) Date: Jun. 29, 2016

(87) PCT Pub. No.: WO2015/101607
PCT Pub. Date: Jul. 9, 2015

(65) Prior Publication Data

US 2016/0318085 A1 Nov. 3, 2016

(30) Foreign Application Priority Data

Dec. 30, 2013 (IT) ..... MI2013A2219

(51) Int. Cl.
*B21D 5/04* (2006.01)
*B21D 5/00* (2006.01)

(52) U.S. Cl.
CPC ..... *B21D 5/04* (2013.01); *B21D 5/004* (2013.01); *B21D 5/006* (2013.01); *B21D 5/045* (2013.01)

(58) Field of Classification Search
CPC ..... B21D 5/04; B21D 5/004; B21D 5/006; B21D 5/045

(Continued)

(56) References Cited

U.S. PATENT DOCUMENTS 9,259,773 B2 * 2/2016 Frigo ..... B21D 5/004
2003/0070463 A1 * 4/2003 Kunze ..... B21D 5/04 72/31.11

(Continued)

FOREIGN PATENT DOCUMENTS

JP H-11-123464 A 5/1999
JP 2000 246344 A 9/2000

(Continued)

OTHER PUBLICATIONS

International Search Report (PCT/ISA/210) dated Mar. 18, 2015, by the Japanese Patent Office as the International Searching Authority for International Application No. PCT/EP2014/079385.

(Continued)

*Primary Examiner* — David B Jones
(74) *Attorney, Agent, or Firm* — Buchanan Ingersoll & Rooney PC

(57) ABSTRACT

A machine for bending sheet metal provides at least one sheet metal resting tool, at least one sheet metal pressing tool, and at least one sheet metal bending tool, parallel to one another; for moving the tools along a first and a second axis perpendicular to one another at least two electric motors are provided for moving the sheet metal pressing tool along the second axis, at least two electric motors for moving the sheet metal bending tool along the first axis and at least two electric motors for moving the sheet metal bending tool along the second axis; a command and control unit connected to the electric motors commands and controls the driving of the electric motors to maintain the parallelism between the tools in the operating step. In this manner, using hydraulic drives is avoided.

7 Claims, 13 Drawing Sheets

(58) Field of Classification Search
USPC ..... 72/429, 37
See application file for complete search history.

(56) References Cited

U.S. PATENT DOCUMENTS

| | | | | |
|---|---|---|---|---|
| 2007/0266752 | A1 | 11/2007 | Patuzzi | |
| 2014/0090442 | A1* | 4/2014 | Kunze | B21D 5/045 72/452.1 |

FOREIGN PATENT DOCUMENTS

| | | | |
|---|---|---|---|
| JP | 2006-323587 | A | 11/2006 |
| WO | WO 2004/108318 | A1 | 12/2004 |
| WO | WO 2007/125900 | A1 | 11/2007 |

OTHER PUBLICATIONS

Written Opinion (PCT/ISA/237) dated Mar. 18, 2015, by the Japanese Patent Office as the International Searching Authority for International Application No. PCT/EP2014/079385.

* cited by examiner

MACHINE FOR BENDING SHEET METAL

BACKGROUND OF THE INVENTION

The object of the present invention is a machine for bending sheet metal.

PRIOR ART

Machines for bending sheet metal are known, for example for making panels and other components of household appliances such as refrigerators, washing machines and dryers, dish-washing machines, ovens and others.

Such machines comprise a sheet metal resting tool, a sheet metal pressing tool, and a sheet metal bending tool, parallel to one another, and each with a particular profile. The sheet metal resting tool normally moves according to a horizontal axis X, the sheet metal pressing tool normally moves according to a vertical axis Y that is perpendicular to the axis X, and the bending tool moves according to the two axes X and Y or, by interpolation, according to a rectilinear and/or curvilinear trajectory.

The sheet metal that has to be bent, for example along a longitudinal edge, is tightened between the sheet metal resting tool and the sheet metal pressing tool with the edge to be bent protruding. The bending tool uses a preset bending movement to bend the edge of the sheet metal over an edge of one or the other of the two sheet metal resting and sheet metal pressing tools. The profile of the tools correspondingly determines the bending profile.

Hydraulic drives are normally used for moving the tools.

However, these hydraulic drives have the drawback that a variation in the temperature of the oil and in the type of oil used, or a loss of oil, can determine a variation in the bending parameters.

Further, the hydraulic drive is rather a stiff system that does not enable parallelism errors between tools in the machine to be corrected.

Lastly, the hydraulic drives require constant maintenance, which affects production costs.

OBJECT OF THE INVENTION

The object of the present invention is to overcome the above drawbacks.

SHORT DESCRIPTION OF THE INVENTION

This object is achieved by a machine for bending sheet metal according to claim 1.

SHORT DESCRIPTION OF THE DRAWINGS

In order to understand the invention better, an embodiment thereof is disclosed below by way of non-limiting example, illustrated in the attached drawings, in which.

DETAILED DESCRIPTION OF THE INVENTION

Figure 1:
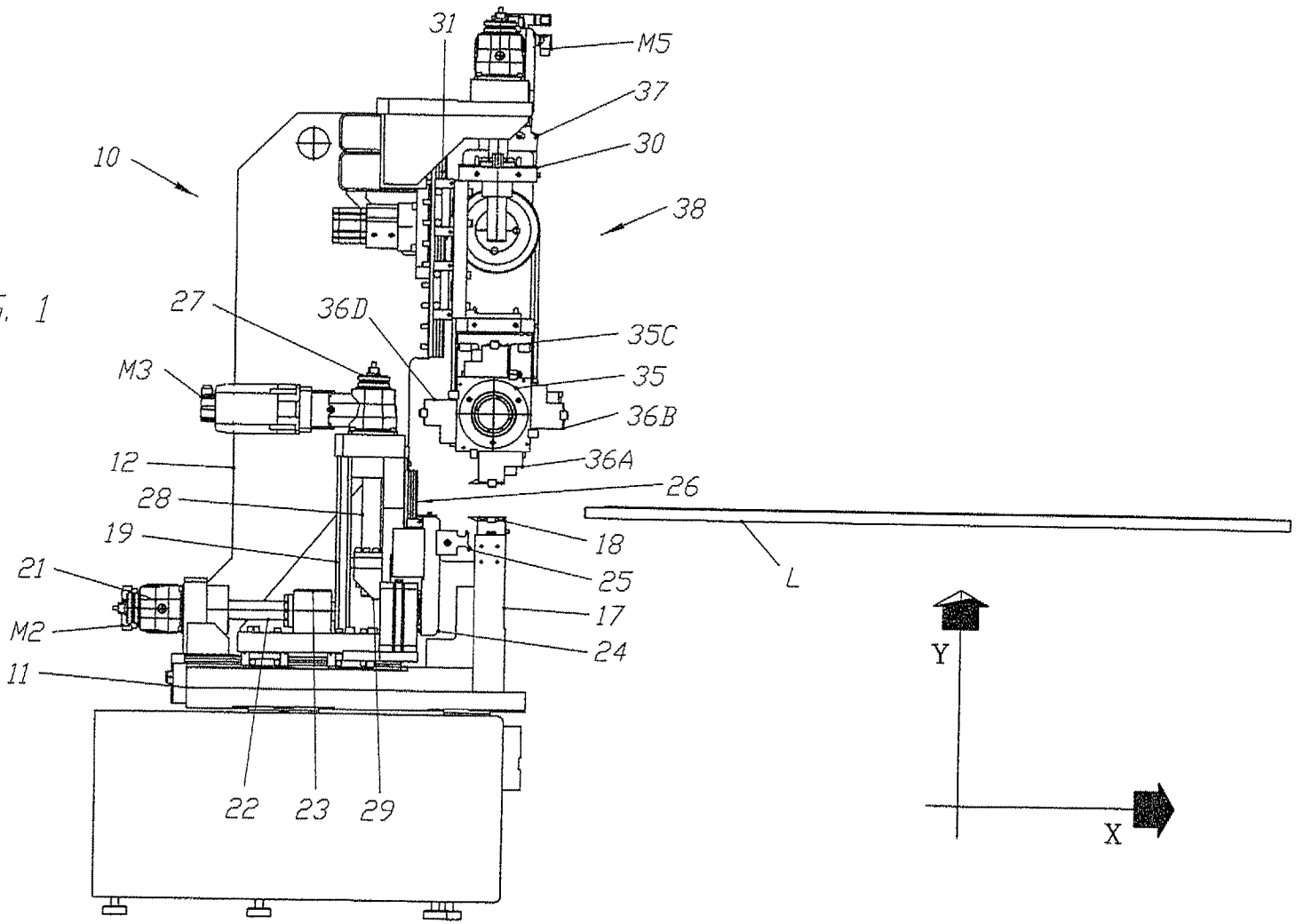
FIG. 1 is a side view of a machine for bending sheet metal according to the invention.
Figure 2:
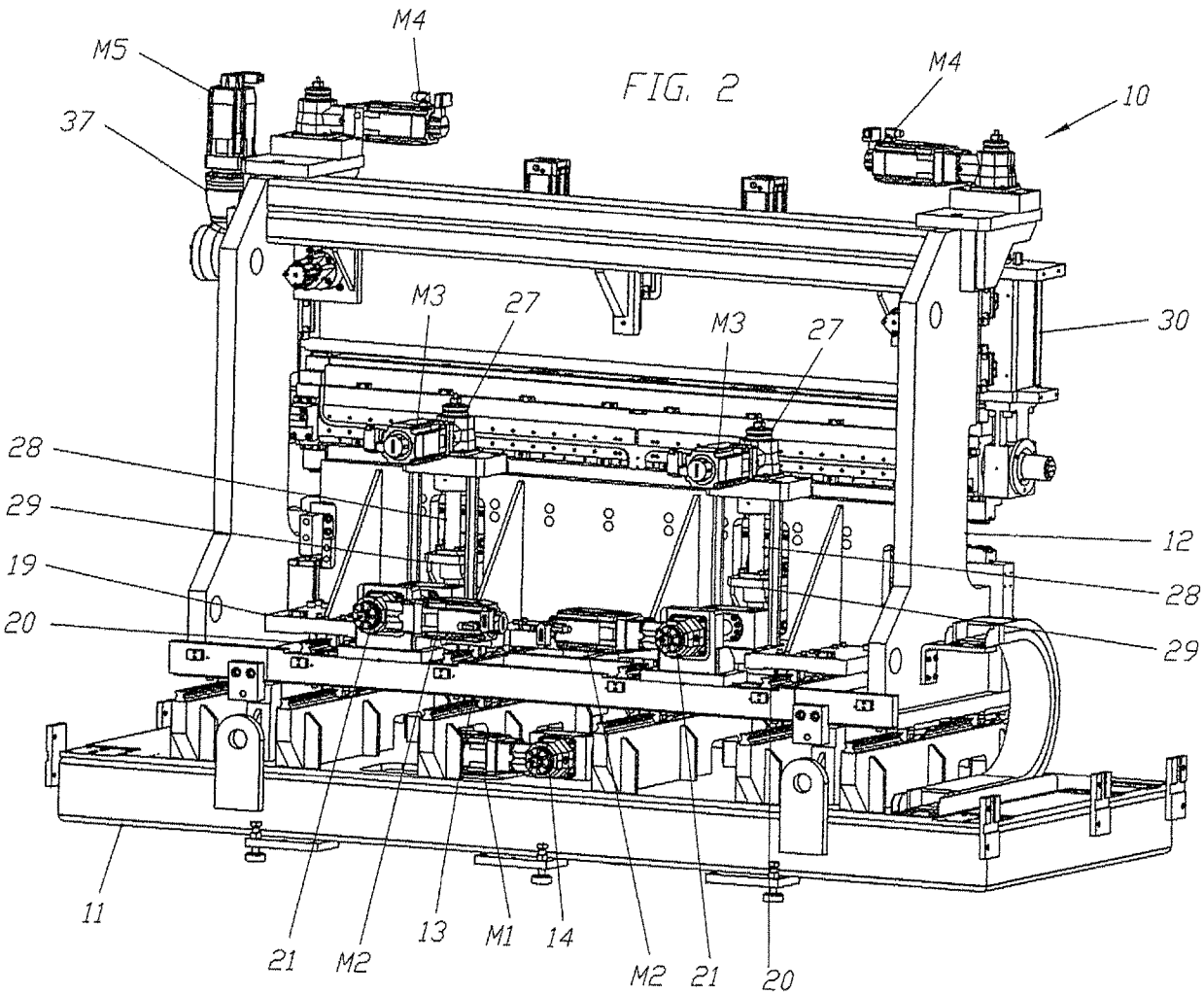
FIG. 2 is a rear perspective view of the machine in FIG. 1.
Figure 3:
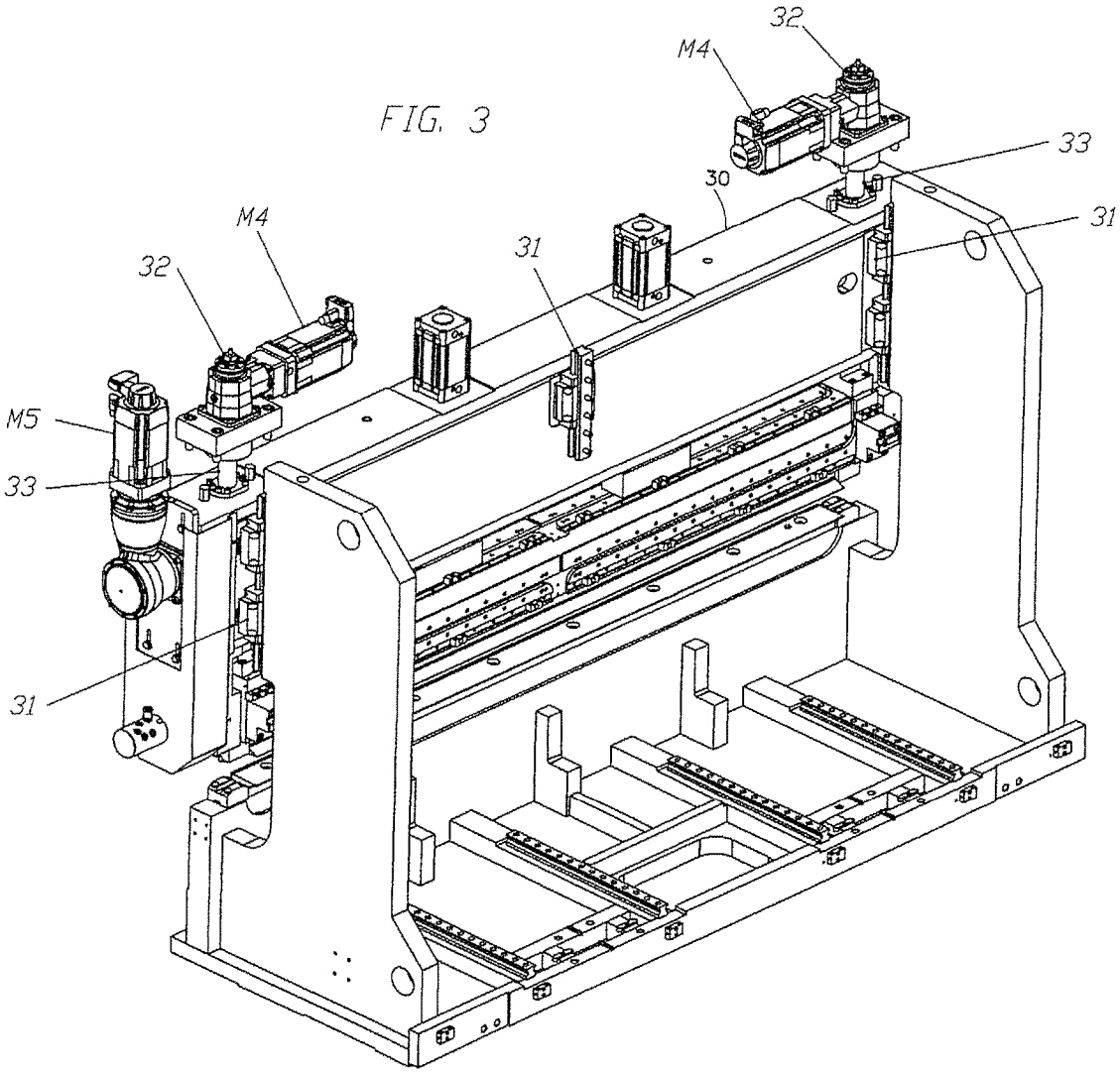
FIG. 3 is another rear perspective view of the machine in FIG. 1 with some components removed.
Figure 4:
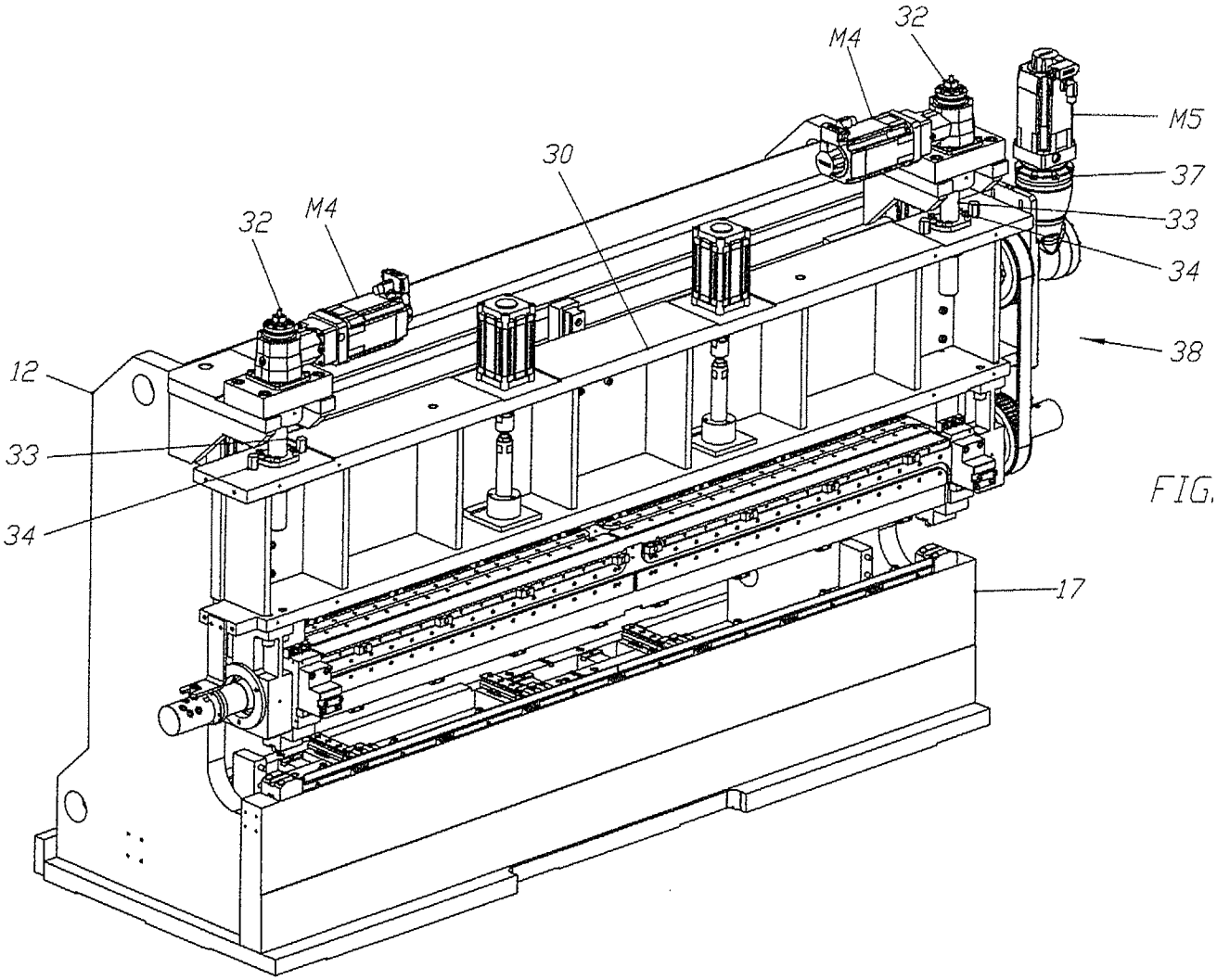
FIG. 4 is a front perspective view of the machine in FIG. 1.
Figure 5:
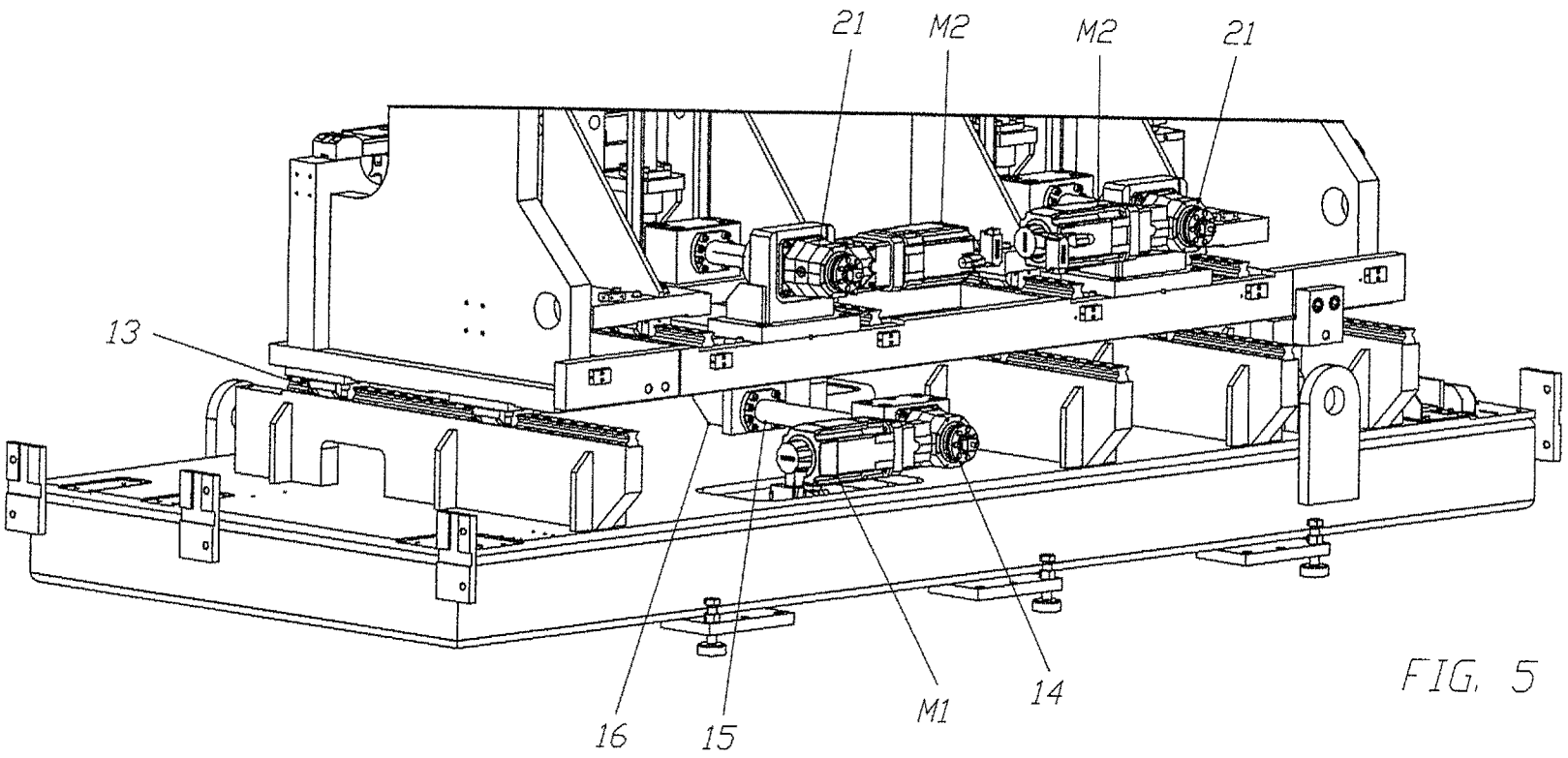
FIG. 5 is a perspective view of a detail of the machine in FIG. 1.

With reference to FIGS. 1, 2, 5, the illustrated machine for bending sheet metal, indicated generally with 10, has a base 11 and a frame 12 that is mounted slidably on the base 11 through a series of horizontal rectilinear recirculating ball guides 13. The frame 12 is moved along the guides 13 according to a horizontal axis X (indicated in FIG. 1) by means of an electric motor M1. The motor M1 is fixed to the base 11 and moves, via a reduction gear 14, a threaded shaft 15 that is screw-coupled with a recirculating ball nut 16 that is integral with the frame 12, so as to cause the frame 12 to move with respect to the base 11 along the axis X.

With reference to FIG. 1, a longitudinal front wall 17 is integral with the frame 12, a rectilinear sheet metal resting tool 18 being fixed on the longitudinal front wall 17, the sheet metal resting tool 18 having a horizontal longitudinal extent that is perpendicular to the axis X, and having a preset section profile.

With reference to FIGS. 1, 2, on the frame 12 a slide 19 is mounted that is arranged opposite and parallel to the wall 17. The slide 19 is mounted slidably on the frame 12 through a series of rectilinear recirculating ball guides 20. The slide 19 is moved along the guides 20 according to the horizontal axis X by two electric motors M2. Each motor M2 is fixed to the frame 12 below and moves, via a reduction gear 21, a threaded shaft 22 that is screw-coupled with a recirculating ball nut 23 that is integral with the slide 12. The two motors M2 thus determine movement of the slide 19 with respect to the frame 12 along the axis X.

With reference to FIGS. 1, 2, on the slide 19, at the wall 17, a longitudinal plate 24 is mounted slidably on which is fixed a rectilinear sheet metal bending tool 25, having a longitudinal horizontal extent, that is perpendicular to the axis X, and having a preset section profile. The plate 24 is slidable along a series of vertical recirculating ball nut guides 26. The plate 24 is moved along the guides 26 according to a vertical axis Y, which is perpendicular to the axis X, by two electric motors M3. Each motor M3 is fixed to the slide 19 above and moves, via a reduction gear 27, a threaded shaft 28 that is screw-coupled with a recirculating ball nut 29 that is integral with the plate 24. The two motors M3 thus determine movement of the slide 19 with respect to the frame 12 along the axis Y.

With reference to FIGS. 1-4, on the upper part of the frame 12 a longitudinal beam 30 is mounted. The beam 30 is slidable with respect to the frame 12 along a series of vertical recirculating ball nut guides 31 and is moved along the guides 31 according to the vertical axis Y by two electric motors M4. Each motor M4 is fixed above to the frame 12 and moves, via a reduction gear 32, a threaded shaft 33 that is screw-coupled with a recirculating ball nut 34 that is integral with the beam 30. The two motors M4 thus determine the movement of the beam 30 with respect to the frame 12 along the axis Y.

Still with reference to FIGS. 1-4, on the beam 30 a longitudinal tool-holding bar 35 is mounted rotatably. The bar 35 has a square section and on each of the four faces a corresponding sheet metal pressing tool is fixed; the four sheet metal pressing tools, indicated specifically with 36A, 36B,36C,36D, have a horizontal longitudinal extent, which is perpendicular to the axis X, and each has a preset section profile that is different from the others. The bar 35 is rotated by an electric motor M5 fixed to the beam 30 and connected via a reduction gear 37 and a belt transmission 38 to the tool-holding bar 35.

Figure 6:
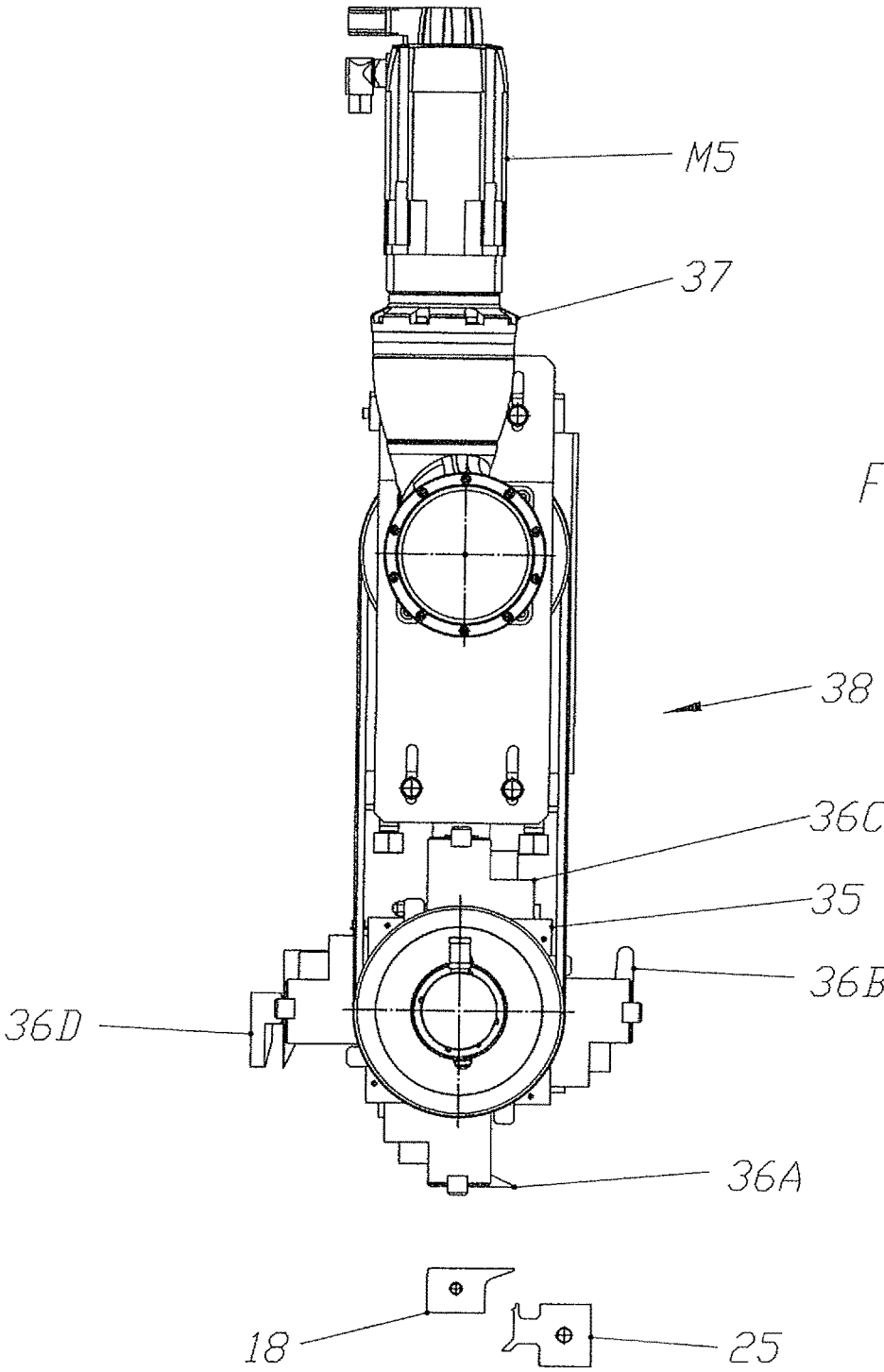
FIG. 6 is a side view of another detail of the machine in FIG. 1.

In FIG. 6 there is shown the arrangement of the tools 18, 25, 36A-D, which correspond to one another operationally and are parallel to one another.

Figure 7:
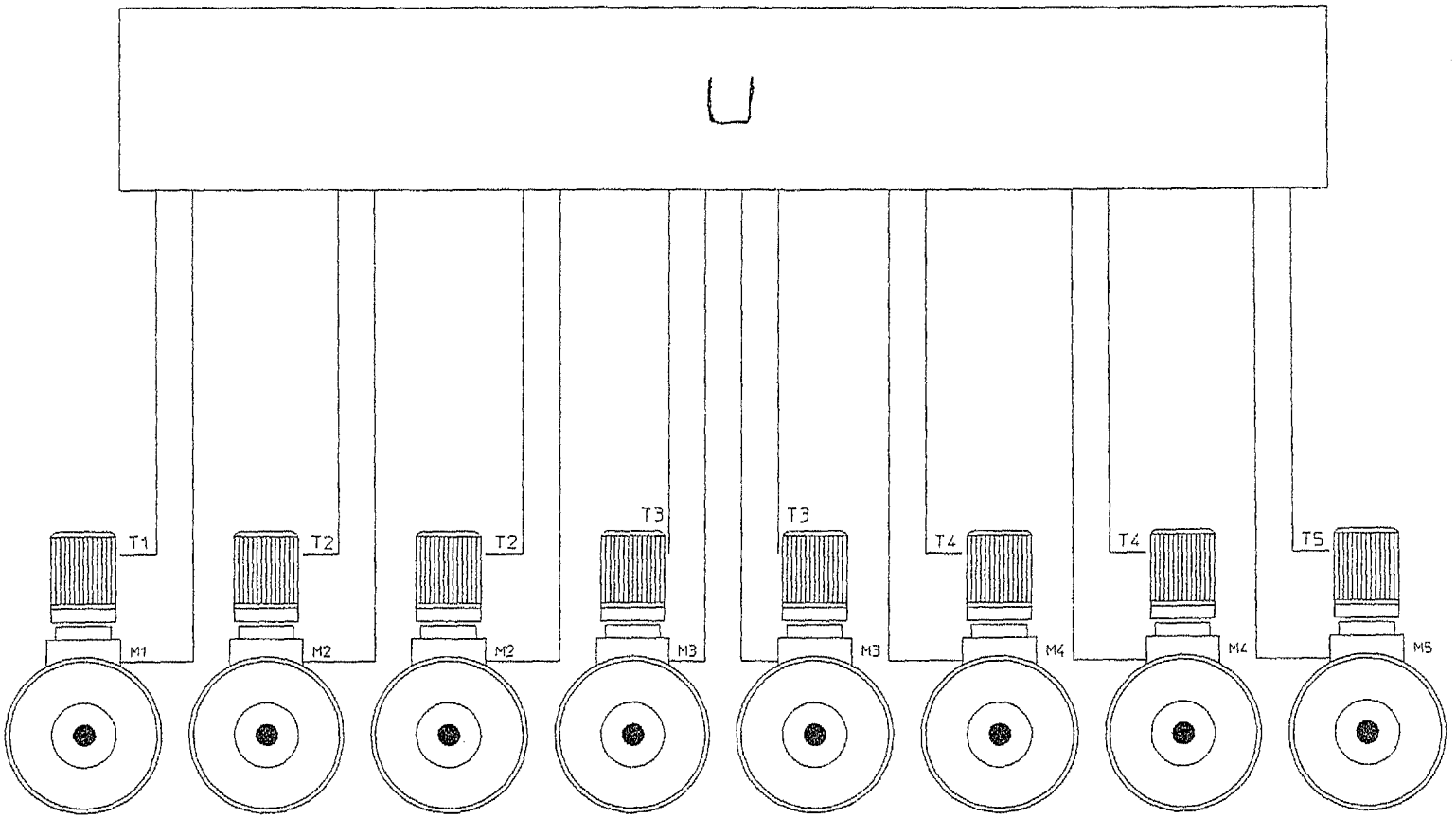
FIG. 7 is a simplified diagram of the command and control system of the machine in FIG. 1.

With reference to FIG. 7, with the motors M1, M2, M3, M4, and M5 corresponding angular position transducers of the driving shaft are coupled, which are indicated respectively with T1, T2, T3, T4, and T5. The motors M and the transducers T are all connected to a command and control unit U.

The operation of the disclosed and illustrated machine 10 for bending sheet metal is as follows.

The sheet metal, indicated with L in FIG. 1, is conveyed by a suitable conveyor to at the machine 10 until it rests, along a side to be bent, on the tool 18.

The command and control unit U first drives the motor M1 so as to move the frame 12 with respect to the base 11 along the axis X so as to position the tool 18 correctly with respect to the sheet metal L for bending the edge.

Then the unit U drives the two motors M4 so as to lower the beam 30 and with the beam 30 the tool-holding bar 35 along the axis Y until the tool of the preselected bar, for example the tool 36A, presses the sheet metal L against the tool 18 so as to keep the sheet metal L blocked.

At this point, the unit U suitably drives the motors M2 and M3 so as to move the bending tool 25 to bend the edge of the sheet metal L with a movement according to the two axes X and Y or, by interpolation, according to a rectilinear and/or curvilinear trajectory, in accordance with a well-known technique. The profile of the tools 18, 25,36A-D and the movements of the bending tool 25 determine the type of bending of the edge of the sheet metal L.

If it is desired to change the sheet metal pressing tool the unit U drives the motor M5 that determines the rotation of the bar 35 until the preset sheet metal pressing tool 36B,36C or 36 D is above the sheet metal resting tool 18.

The angular position transducers T1-T5 enable the unit U to control with precision the rotation of the driving shafts and thus the movement of the tools 18, 25,36A-D.

The system with two electric motors that moves the single tool enables the tools to be kept perfectly parallel. Possible deformation that the tool may suffer can be also be corrected by acting in a suitable manner on the motors in a differentiated manner and counting on the mechanical clearance between screw shafts and ball nuts. Such advantages cannot be obtained when hydraulic drives are used for moving the tools.

Further, unlike hydraulic drives, in the machine 10 there are no variations over time in bending parameters.

Lastly, the machine 10 requires low maintenance and thus enables production costs to be lowered.

A simplified machine embodiment can also be obtained that provides a sole sheet metal pressing tool and not a bar with several sheet metal pressing tools.

It is clear that variants of and/or additions to what has been disclosed and illustrated above can be provided.

Also more than two electric motors can be provided to drive a single tool, in function, for example, of the length of the tool.

Also the system of transmission via threaded shaft and ball nut can be replaced by an equivalent transmission system, even if the disclosed and illustrated transmission system is particularly effective.

Obviously, there can be variations in the number of tools and configuration versions and arrangement of the various parts of the disclosed and illustrated machines.

In FIGS. 8-13, the machine 10 also includes a positioning unit 50 of the sheet metal to be bent.

The positioning unit 50 comprises a supporting rack 51 on which a series of longitudinal belt-shaped brush surfaces 52 is mounted that are parallel to one another and have the function of supporting the sheet metal to be positioned.

In the central part of the positioning unit 50, between the belt-shaped surfaces 52, a gap is obtained along which a rotating board 53 runs that is provided with suction cups 54 activated by a pneumatic system that is not illustrated.

Figure 11:
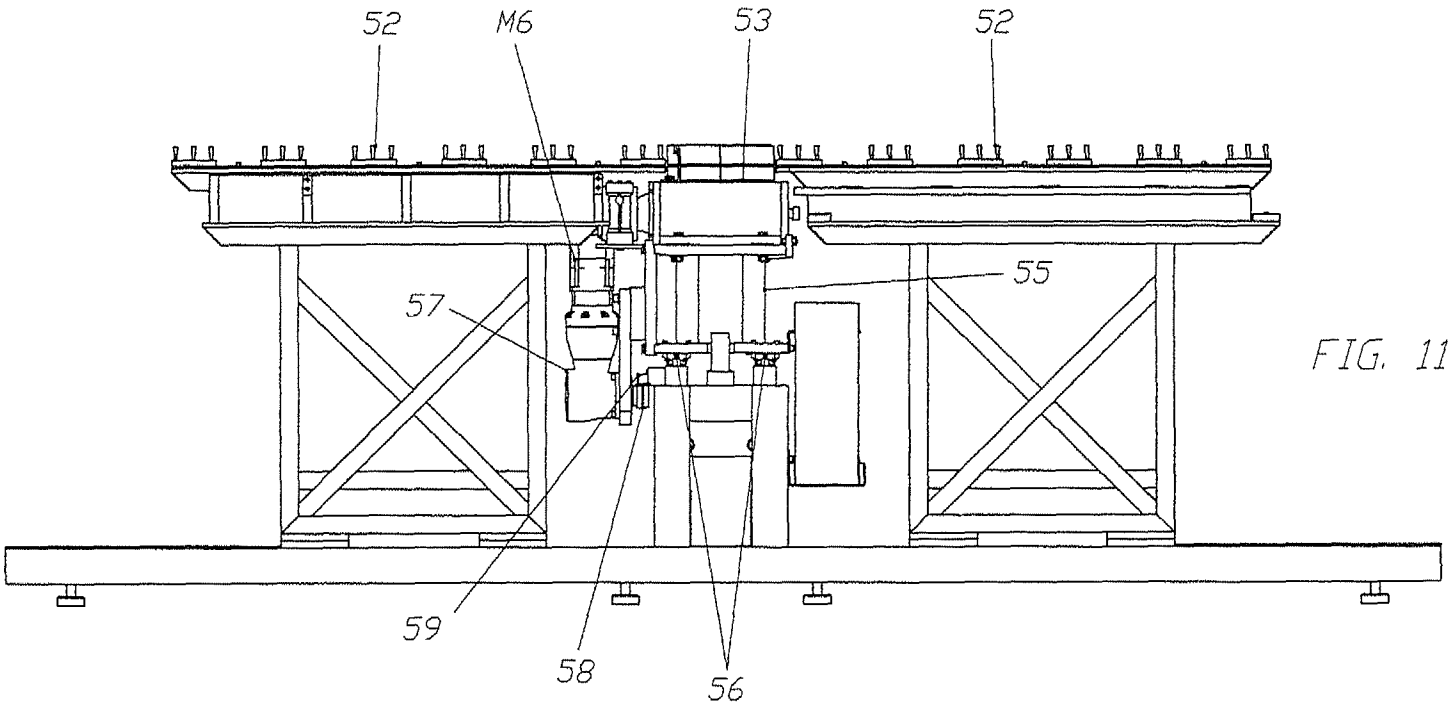
FIG. 11 is a front view of the sheet metal positioning unit.
Figure 12:
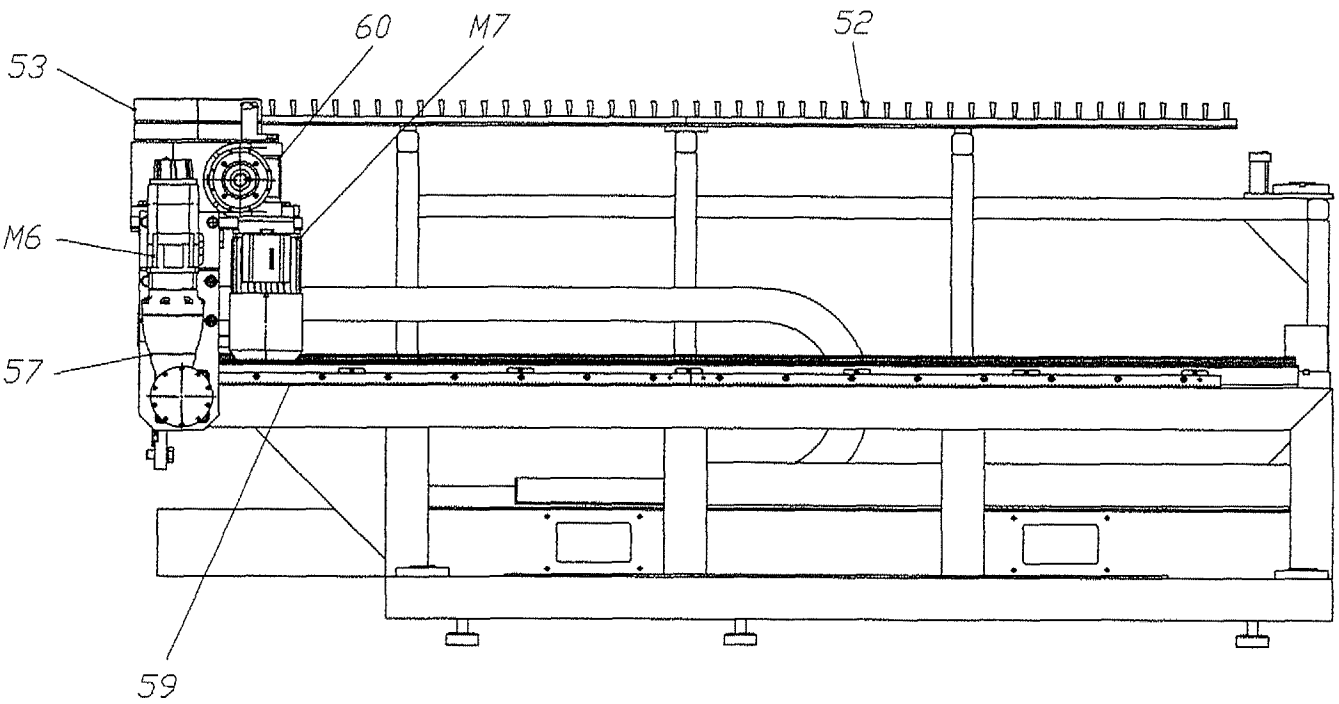
FIG. 12 is a side view of the sheet metal positioning unit in FIG. 11.

For the movement, with particular reference to FIGS. 11, 12, the rotating board 53 is mounted on a carriage 55 that is movable along longitudinal guides 56. An electric motor M6 is integral with the board 53, which electric motor M6 is connected, via a reduction gear 57, to a pinion 58 that engages a longitudinal rack 59. An angular position transducer of the shaft of the motor M6 is provided that is not illustrated.

For rotation, with reference to FIG. 12, a further electric motor M7 is provided that is integral with the board 53 and connected via a reduction gear 60 to a known kinematic mechanism, for example a worm screw and helical ring gear, which is not illustrated, which transmits rotation of the shaft of the motor M7 to the board 53. In this case, there is also provided an angular position transducer of the shaft of the motor M7, which is not illustrated.

The motors M6 and M7 and the respective angular transducers are connected to the command and control unit U of the machine 10.

On the front part of the positioning unit 50 a series of reference stakes is provided that enable the sheet metal to be placed initially in a correct manner on the unit 50.

Figure 8:
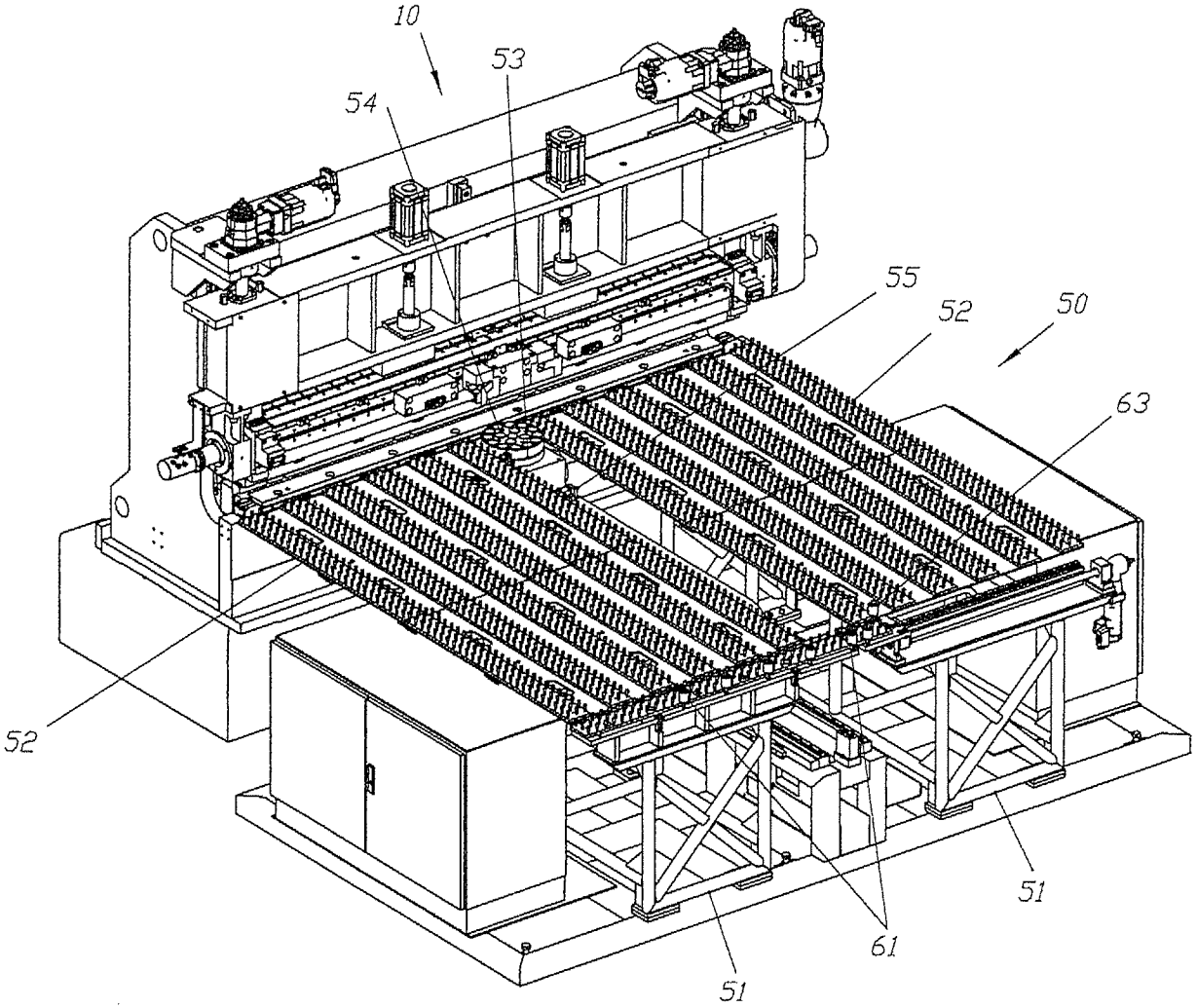
FIG. 8 is a perspective view of the machine in FIG. 1, also comprising a sheet metal positioning unit.
Figure 9:
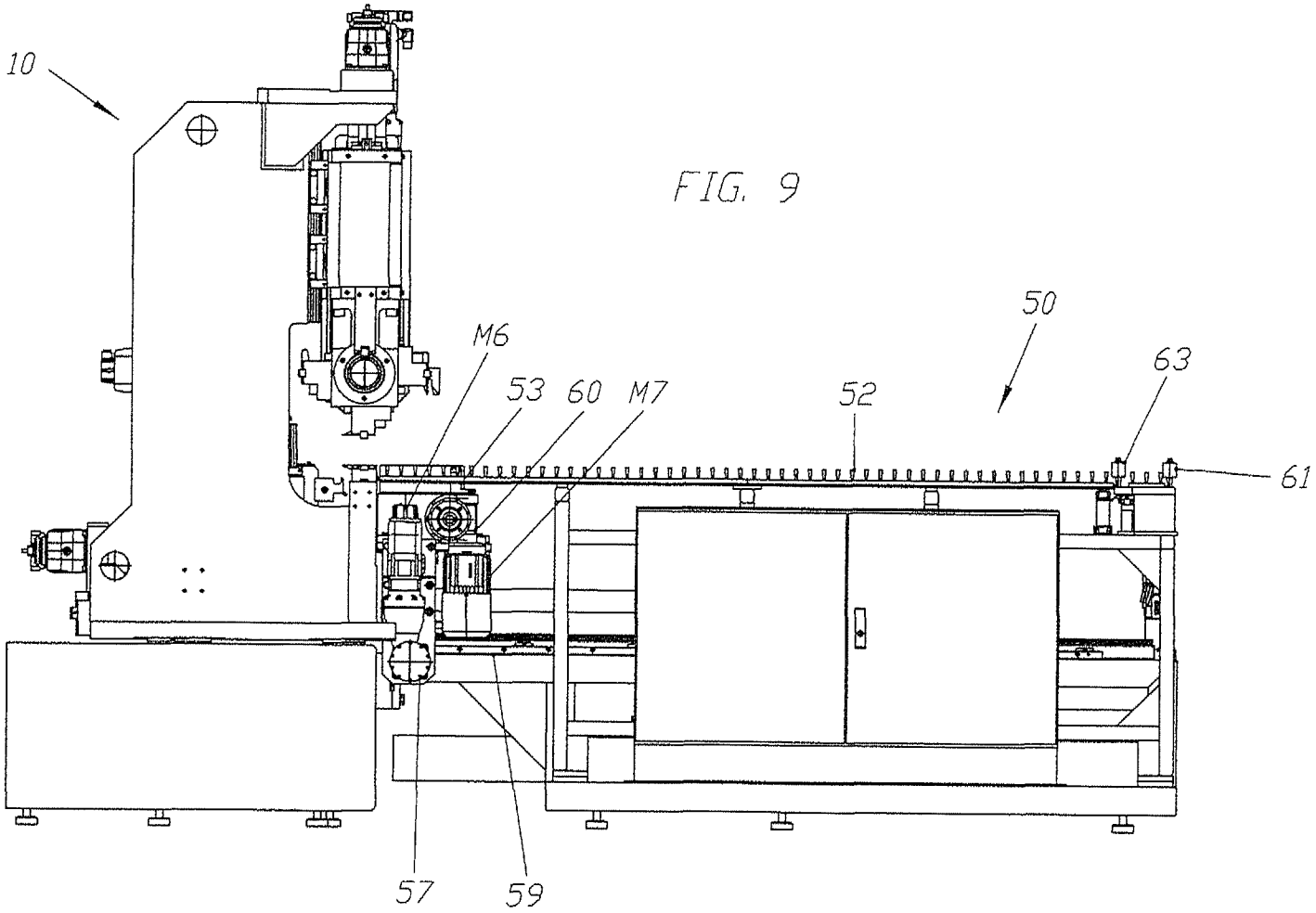
FIG. 9 is a side view of the machine in FIG. 8.
Figure 10:
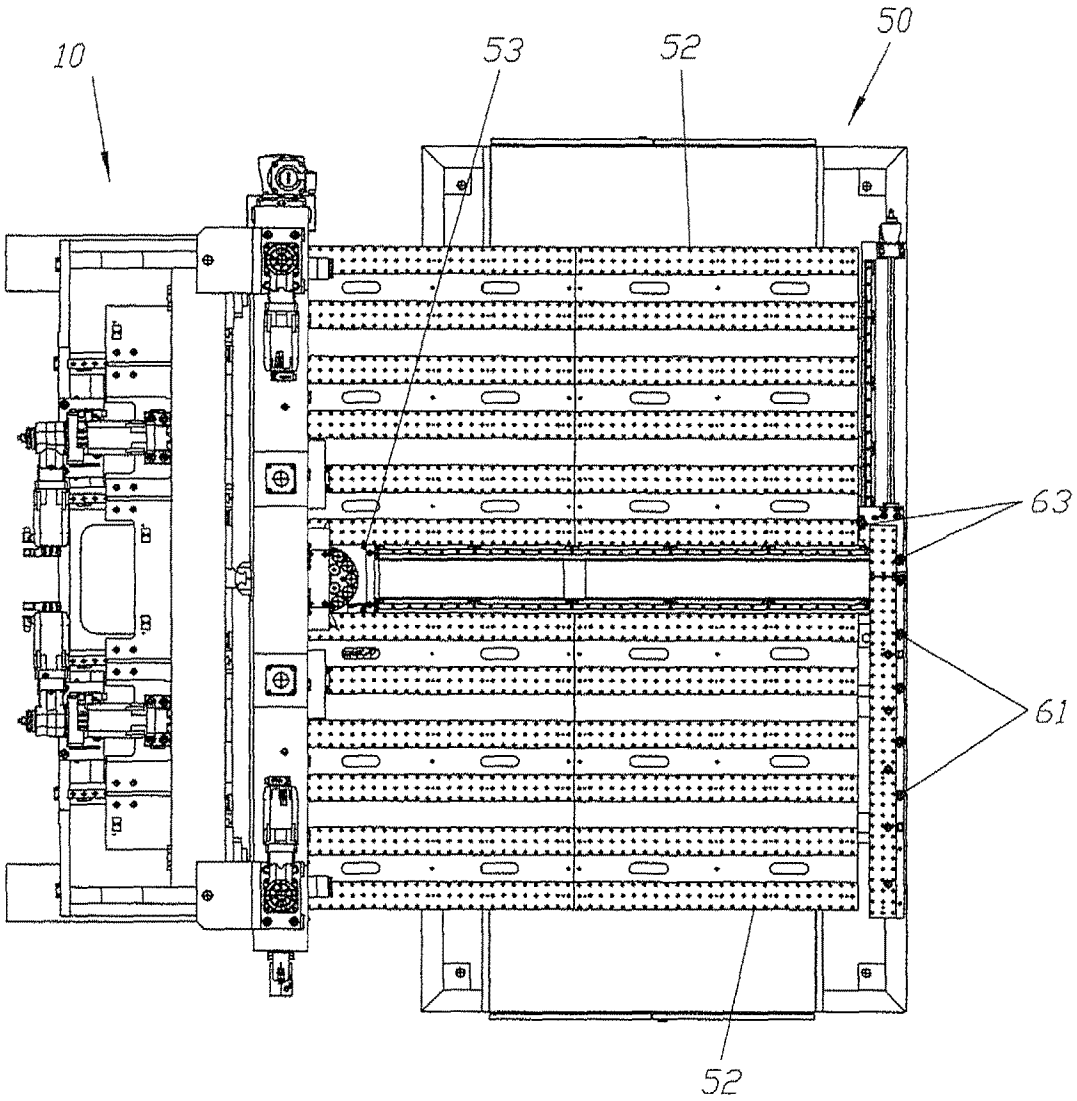
FIG. 10 is a top view of the machine in FIG. 8.
Figure 13:
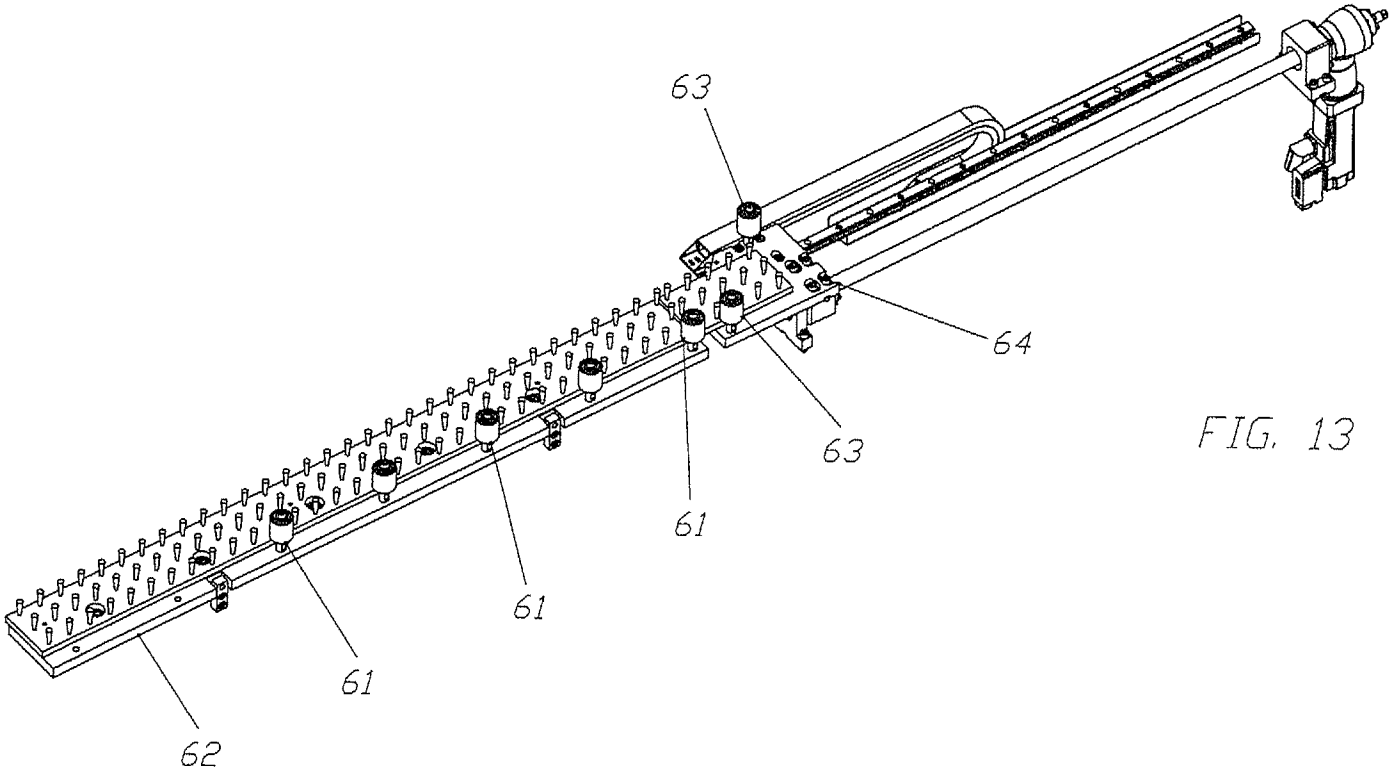
FIG. 13 is a perspective view of a detail of the sheet metal positioning unit in FIG. 11.

With reference to FIGS. 8, 10, 13, a transverse row of reference stakes 61 is provided that are mounted on a fixed frame 62 and a pair of reference stakes 63 mounted on a movable frame 64 and arranged along an axis intersecting the axis along which the stakes 61 are arranged.

The operation of the positioning unit 50 is as follows.

The rotating board 53 is taken to the front part of the machine when the motor M6 is driven. The sheet of sheet metal is rested on the rotating board 53 and on the belt-shaped surfaces 52. The reference stakes 61 and 63 enable the sheet metal to be positioned correctly by placing the sheet metal at the reference stakes 61 and 63.

At this point the suction cups 54 are activated to hold the sheet metal on the rotating board 53 and the rotating board 53 is then moved to take the sheet metal to the rear part of the positioning unit 50 so that one side of the sheet metal is on the tool 18.

The machine 10 bends the side of the sheet metal in the manner seen above.

If it is desired to bend another side of the sheet metal the motor M7 is activated to rotate the rotating board 53 and take another side of the sheet metal to the tool 18.

After bending of the sides of the sheet metal has terminated, the rotating board 53 with the sheet metal is returned to the front part of the positioning unit 50 to remove the machined sheet metal.

The angular transducers of the motors M6 and M7 provide to signal to the central unit U the position of the rotating board 53 for precision positioning of the sheet metal.

A machine is thus obtained for sheet metal bending with a very simple and effective positioning unit.

It is clear that also with regard to the positioning unit, variations and/or additions are possible, for example in the configuration and in the number of the elements.

The invention claimed is:

1. A machine for bending sheet metal comprising:

at least one sheet metal resting tool;

at least one sheet metal pressing tool;

at least one sheet metal bending tool;

a first moving means for moving the at least one sheet metal resting tool along at least one first axis;

a second moving means for moving the at least one sheet metal pressing tool along at least one second axis that is perpendicular to the at least one first axis;

a third moving means for moving the at least one sheet metal bending tool along at least the at least one first and the at least one second axis, wherein said second moving means includes, at least two first electric motors for moving the at least one sheet metal pressing tool along the at least one second axis, wherein said third moving means includes at least two second electric motors for moving the at least one sheet metal bending tool along the at least one first axis, and said third moving means includes at least two third electric motors for moving the at least one sheet metal bending tool along the at least one second axis; and a command and control unit connected to the electric motors and configured to command and control driving of the electric motors to maintain parallelism between the tools in an operating step; and a single supporting means wherein a plurality of sheet metal pressing tools are mounted on the single supporting means, the single supporting means being rotatably movable to bring into operating position at least one selected sheet metal pressing tool of the at least one sheet metal pressing tools, the at least two first electric motors configured to move the at least one sheet metal pressing tool by acting on said single supporting means.

2. The machine according to claim 1, where a transmission of motion between each electric motor and a respective tool is obtained through a threaded shaft, driven by a respective electric motor and a recirculating ball nut, connected to the respective tool, that is screw-coupled with the threaded shaft.

3. A machine for bending sheet metal comprising:

at least one sheet metal resting tool;

at least one sheet metal pressing tool;

at least one sheet metal bending tool;

a first moving means for moving the at least one sheet metal resting tool along at least one first axis;

a second moving means for moving the at least one sheet metal pressing tool along at least one second axis that is perpendicular to the at least one first axis;

a third moving means for moving the at least one sheet metal bending tool along at least the at least one first and the at least one second axis, wherein said second moving means includes, at least two first electric motors for moving the at least one sheet metal pressing tool along the at least one second axis, wherein said third moving means includes at least two second electric motors for moving the at least one sheet metal bending tool along the at least one first axis, and said third moving means includes at least two third electric motors for moving the at least one sheet metal bending tool along the at least one second axis; and a command and control unit connected to the electric motors and configured to command and control driving of the electric motors to maintain parallelism between the tools in an operating step;

where a transmission of motion between each electric motor and a respective tool is obtained through a threaded shaft, driven by a respective electric motor and a recirculating ball nut, connected to the respective tool, that is screw-coupled with the threaded shaft, a corresponding angular transducer coupled to each electric motor and connected to the command and control unit to provide data about an angular position of each threaded shaft to the command and control unit.

4. The machine according to claim 3, comprising at least one fourth electric motor for moving the at least one sheet metal resting tool through a threaded shaft, the at least one fourth electric motor being connected to the command and control unit.

5. The machine according to claim 4, comprising:

a corresponding angular transducer coupled to each at least one fourth electric motor, each angular transducer being connected to the command and control unit to provide data about an angular position of a respective threaded shaft to the command and control unit.

6. A machine for bending sheet metal comprising:

at least one sheet metal resting tool;

at least one sheet metal pressing tool;

at least one sheet metal bending tool;

a first moving means for moving the at least one sheet metal resting tool along at least one first axis;

a second moving means for moving the at least one sheet metal pressing tool along at least one second axis that is perpendicular to the at least one first axis;

a third moving means for moving the at least one sheet metal bending tool along at least the at least one first and the at least one second axis, wherein said second moving means includes, at least two first electric motors for moving the at least one sheet metal pressing tool along the at least one second axis, wherein said third moving means includes at least two second electric motors for moving the at least one sheet metal bending tool along the at least one first axis, and said third moving means includes at least two third electric motors for moving the at least one sheet metal bending tool along the at least one second axis; and a command and control unit connected to the electric motors and configured to command and control driving of the electric motors to maintain parallelism between the tools in an operating step;

a positioning unit for picking and positioning the sheet metal at the at least one sheet metal resting tool, wherein the positioning unit includes at least a board for transporting the sheet metal at the at least one sheet metal resting tool, equipped with means for holding the sheet metal on the board, wherein the board is linearly movable and rotatable.

7. The machine according to claim 6, wherein the positioning unit comprises fixed reference elements and/or movable reference elements for correct positioning of the sheet metal to be machined on the positioning unit.

* * * * *